US007189128B2

(12) United States Patent
Halliday

(10) Patent No.: US 7,189,128 B2
(45) Date of Patent: Mar. 13, 2007

(54) MIMETIC GEAR

(76) Inventor: Christopher I. Halliday, 59 Windsor Pl., Collegeville, PA (US) 19426

( * ) Notice: Subject to any disclaimer, the term of this patent is extended or adjusted under 35 U.S.C. 154(b) by 0 days.

(21) Appl. No.: 10/998,217

(22) Filed: Nov. 26, 2004

(65) Prior Publication Data

US 2006/0035544 A1 Feb. 16, 2006

Related U.S. Application Data

(60) Provisional application No. 60/525,292, filed on Nov. 26, 2003.

(51) Int. Cl.
*A63B 31/08* (2006.01)
*B63C 11/02* (2006.01)

(52) U.S. Cl. ..... 441/64; 2/2.15; 2/900; 405/185; 405/186; 428/919

(58) Field of Classification Search ..... 2/2.15, 2/2.16, 2.17, 900; 405/185, 186; 428/919; 441/102–106, 64
See application file for complete search history.

(56) References Cited

U.S. PATENT DOCUMENTS

| | | | | |
|---|---|---|---|---|
| 4,494,245 | A * | 1/1985 | Burkhead et al. | 441/86 |
| 5,203,033 | A * | 4/1993 | Sheppard et al. | 2/69 |
| 5,920,903 | A * | 7/1999 | Koehntop et al. | 2/69 |
| 6,122,855 | A * | 9/2000 | Heuke | 43/42.09 |
| 6,499,145 | B1 * | 12/2002 | Kates | 2/195.1 |
| 6,684,557 | B1 | 2/2004 | Yu | |
| 6,922,935 | B2 | 8/2005 | Yu | |
| 2004/0194188 | A1 * | 10/2004 | Tooley | 2/69 |
| 2006/0121166 | A1 | 6/2006 | Jackie | |

OTHER PUBLICATIONS

Losey et al., The UV visual world of fishes: a review, Journal of Fish Biology, 54, 921-943 (1999).
N. Justin Marshall, Communication and camouflage with the same 'bright' colours in reef fishes, Phil. Trans. R. Soc. Lond. B 355, 1243-1248 (2000).

* cited by examiner

*Primary Examiner*—Sherman Basinger

(57) ABSTRACT

Methods and compositions which can reduce the disturbance to wild life caused when man attempts to interact with wild life and more particularly methods and compositions which can enhance the interaction of man with aquatic life with minimal disturbance to the aquatic life.

13 Claims, 4 Drawing Sheets

Figure 1 - Percentage light loss per meter as a function of wavelength in different types of water: I = extremely clear oceanic water; II = tropical/subtropical oceanic water; III = Oceanic water at temperate latitudes. Curves 1-9: Coastal waters with varying degree of turbidity (from Jerlov 1951, in Dietrich et al. 1975, p. 84).

MIMETIC GEAR

CLAIM TO PRIORITY

The present invention claims priority to U.S. Provisional Patent Application Ser. No. 60/525,292, filed Nov. 26, 2003.

FIELD OF THE INVENTION

The present invention relates generally to methods and compositions which can reduce the disturbance to wild life caused when man attempts to interact with wild life and more particularly methods and compositions which can enhance the interaction of man with aquatic life with minimal disturbance to the aquatic life.

BACKGROUND OF THE INVENTION

Diving is one of the fastest growing recreational activities in the world. Each year, large numbers of people become proficient in self contained underwater breathing apparatus (SCUBA) techniques.

However, as man continues to explore aquatic environments, he can often find himself in confrontation with large and/or dangerous predatory animals, or animals which see man as nothing more than a possible meal or a territorial threat. Further, when he is isolated, injured, and/or unarmed he is at an even larger disadvantage, such predatory animals can present a real and unmanageable danger.

Therefore, Navy personnel, fishermen, other sailors, surfers, scuba divers, free divers, windsurfers and other persons engaged in water sports/activities can often find themselves in unexpected confrontations with potential aquatic predators.

An example of a method for repelling predatory animals by inducing an avoidance response is set forth in U.S. Pat. No. 4,494,245 (the '245 patent). The '245 patent describes that the use of aposomatic patterns and coloration can be effective at repelling certain types of predators such as the docile nurse shark. In particular, the '245 patent describes using the sea snake *Pelamis platurus*' distinctive coloration, which includes a brightly yellow colored body having thereon irregular but yet very distinct black spots.

Although avoiding aquatic predators is desirable, closely approaching non-predatory animals (animals that are generally considered to not prey on man, also referred to herein as "passive animals" or "generally passive animals") is also desirable. Additionally, because man is clumsy and relatively foreign in appearance to aquatic animals, many of the generally passive animals tend to stay away from man.

One form of equipment that can permits aquatic animals to closely approach man, while reducing the incidence of detection of man, is camouflage. For underwater activity, camouflage wetsuits such as those manufactured under the trademarks Deep Thought™, and by Omer™ have been found to be at least partially effective at reducing the incidence of detection of an underwater hunter (a diver that uses spear-guns and the like) by an aquatic animal. It is believed that such wetsuits function by breaking up the body outline of the underwater hunter, thereby allowing the underwater hunter to more easily approach prey undetected.

However, because such wetsuits are based on static camouflage techniques, the camouflage wetsuits are less effective while man is moving through the water. Further, it is believed that such camouflage wetsuits do not inhibit a predator/prey recognition response (described below) in the animal once the wearer is seen by a predatory animal or generally passive animal. Further, such wetsuits do not consider or take into account the particulars of the visual acuity of animals that live at depth, i.e. certain wavelengths of light are visible to some aquatic animals that are not visible to humans.

Lastly, for a recreational diver, hiding from aquatic animals can be undesirable because a recreational diver typically desires to have sustained interaction with generally passive animals.

SUMMARY OF THE INVENTION

In one embodiment, the present invention includes method and compositions for a target animal to passively interact with a predatory animal by the use of patterns and coloration. The method includes the steps of determining a coloration pattern having at least two distinct colors, applying the determined coloration pattern to one or more selected items adjacent the target animal, wherein the coloration pattern inhibits the predatory animal's ability to recognize the target animal as prey.

In another embodiment, the present invention includes compositions and methods for a target animal to passively interact with a generally passive animal by the use of patterns and coloration. The method includes the steps of determining a coloration pattern having at least two distinct colors, applying the determined coloration pattern to one or more selected items adjacent the target animal and wherein the coloration pattern inhibits a generally passive animal's ability to recognize the target animal as a potential predator.

DETAILED DESCRIPTION

Figure 1:
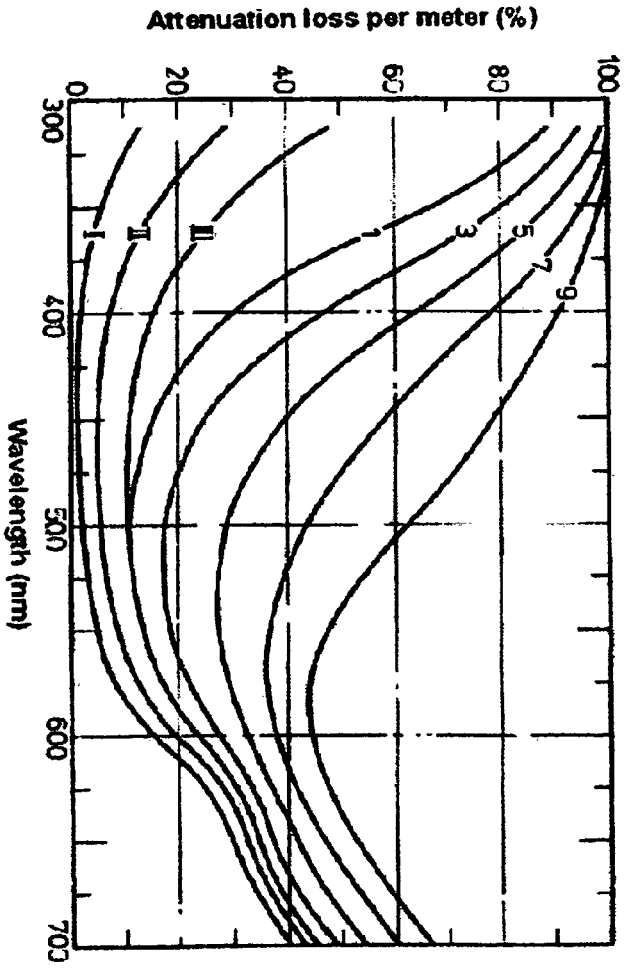
FIG. 1 shows a the percentage loss of light per meter as a function of wavelength.

To date, it is believed that no aquatic gear/equipment suitable for use with aquatic gear has been designed to take advantage of the unique predator/prey recognition pathways of aquatic animals or the optic acuity of aquatic animals. Further, it is believed that no aquatic gear (including but not limited to swimsuit/bathingsuits, wetsuit, booties, dive skin, rashguards, buoyancy compensating device, fins, mask, hoses, snorkel, weight belt, drysuit, semi-drysuit, flashlights, dive-reel, buoyancy bags, dive knife, etc., hereafter referred to generally as "aquatic gear"), has been designed such that either alone or in combination as a whole, the aquatic gear exploits the predator/prey recognition pathways to protect the wearer from predators. Additionally, it is believed that no SCUBA equipment has been designed such that either alone or in combination as a whole, the equipment exploits the predator/prey recognition pathways to enhance the wearer's interaction with non-predatory marine life.

The present invention is directed to methods, kits and compositions which can 1) reduce the disturbance to wild life caused when man attempts to interact with wild life. In some preferred embodiments, the present invention is directed to methods and compositions which can enhance the interaction of man with aquatic life with minimal disturbance to the aquatic life.

In certain embodiments, the present invention employs colors and patterns of colors (in combination the terms are collectively referred to as a "coloration pattern") on aquatic gear (also referred to as "aquatic equipment"). In one embodiment, a coloration pattern of the present invention is designed to exploit the decision making pathways by which a predator recognizes prey. In another embodiment a coloration pattern is designed to exploit the decision making pathways by which a potential prey recognizes predators. Such exploitation can 1) provide additional safety to man in the presence of potential predators, without causing injury to or significantly disturbing an aquatic predator, and/or 2) to enhance interaction of man with generally passive animals. In yet another embodiment of the present invention, the coloration pattern is attractive to an aquatic animal.

Accordingly, certain embodiments of the present invention 1) exploit the predator/prey recognition pathways, and/or 2) use visual queues to make the wearer/user of the present invention more attractive to aquatic animals.

1. The Predator/Prey Recognition Pathways

It has recently been discovered that predators, both land and aquatic, have similar decision making pathways when determining whether to attack another animal as prey. The pathways are set forth in more detail hereafter. In some embodiments of the present invention, these pathways can be exploited to passively protect a wearer from predators using the methods and/or compositions described herein. In other embodiments, these pathways can also be exploited to enhance the interaction of man with passive or non-predatory animals through use of the methods and/or compositions described herein.

The predator/prey recognition pathways will be described and then embodiments of the present invention which exploit the pathways will be described.

A. The Importance of Eyes

A1. For Recognition

First, it has been found that predatory animals, an in particular aquatic predatory animals (e.g., sharks, tarpon and other bone fishes, as well as some other pelagic fish) determine whether a target animal is potential prey by basic body shape and movement of the target animal. Using its senses, an aquatic predator determines whether a target animal has the general shape of prey and whether the target animal moves like prey, i.e. is the other animal fast, slow, injured, moving toward or away, etc.

However, it has recently been discovered that aquatic predators also recognize prey by determining whether the target animal has eyes. More specifically, if the predator can discern one or more eyes, or, even more generally, discern a likely location of one or more eyes, the target animal is more likely to be considered potential prey for the predator. It has been found that if the predator cannot specifically discern eyes on the target animal, or even discern the probable location of eyes on the target animal (from the shape, size, and coloration pattern of the animal), or is confused as to the location of eyes on the target animal, the predator is less likely to consider the target animal as potential prey.

For this reason, it is now believed that many generally passive animals (which can be the prey of predatory animals) have evolved stripes or have particular patterns on their bodies which mask the presence of the animal's eyes, thereby exploiting the predator/prey recognition response of a potential predator to the generally passive animal's advantage. Specifically, many aquatic animals have evolved stripes or other patterns that pass over the animal's eyes—thereby obfuscating the presence of their eyes. For example, the lionfish and pilot fish have colored bands on their bodies that effectively hide the presence of their eyes, i.e. the eyes and bands are about the same color, the bands pass over the eyes, and the eye can blend into the bands of color. Thus, the ability of potential predators to recognize these animals as potential prey can be inhibited because to the predator, the animals do not have specifically discernable eyes.

Additionally, because the photoreceptors of aquatic animals are attuned to different wavelengths than a human eye, as described further below, and because many aquatic animals employ colors that are outside the visual range of humans, the extent of masking of the prey animals may not be readily apparent to a human observer.

A2. For Determination of Size

Furthermore, it has recently been discovered that aquatic animals have great difficulty discerning the size of potential prey animals. Essentially, a predatory animal can have difficulty determining whether another animal is larger or smaller than itself. Thus, a predatory animal can struggle to determine whether it can eat another animal or if the other animal is so large that it might pose a threat to the predator (this is basically a "can I eat it or can it eat me" type decision). It has been found that the primary method used by predators to determine whether another animal is capable of being eaten is the size of the eyes of the target animal relative to the surroundings of the target animal's eyes.

Animals, both aquatic and land based, have exploited this difficulty, which explains why certain animals have large round spots on their bodies. The round spots can be contrasted with a different color background on the animal's body, and serve to confuse a potential predator into believing a small, possibly edible animal, is an animal too large to be eaten or possibly even a predator of the predator. Accordingly, coloration patterns which resemble an "eye-like" pattern can induce an avoidance response, i.e., the predator thinks it may become prey itself and therefore avoids the animal having the relatively large "eye-like" pattern thereon.

Secondly, it is now believed that certain fish have large spots on their tails (e.g., butterfly fish) or other parts of their bodies, because not only do the spots confuse a predator into thinking the prey is larger than it actually is, but the spots also can force the predator to approach the prey from a different direction, for purposes of self preservation. More specifically, predators, both land and aquatic, typically direct attacks behind the eyes of prey, outside the line of sight of the prey, thereby reducing the chance of injury to the predator, as described below in Section A3.

Accordingly, the spots on potential prey can confuse a predator into thinking that it 1) is facing a larger creature than it really is, and 2) confuse the predator into believing that it was seen. Thus, the predator would not attack from the first direction, but rather approach from a different direction. Therefore, the chances of the predator approaching the prey undetected by the prey is also significantly reduced.

A3. Self Preservation

Lastly, assuming that the predator has recognized the potential prey as a suitable type and size, the predator determines where to physically attack the prey. This is an important decision for the predator, because the predator typically does not want the potential prey to injure it, possibly by turning around and biting the predator.

Therefore, predators typically direct attacks just below and or behind the eyes and from a direction that is outside the line of sight of the eyes of the potential prey, for example from behind. This strategy enables the predator to attack the prey from a direction that reduces the chances of detection and injury to the predator because the prey cannot easily turn and injure the predator (e.g., by biting the predator, etc.).

It has been determined that the location and direction of the attack by a predator is directly related to the perception of location and size of the eyes of the potential prey by the predator. However, if the predator cannot discern eyes, the prey recognition response can be inhibited because the predator cannot determine where to direct an attack with the greatest chance of reducing injury to itself.

Accordingly, in one embodiment of the present invention, a coloration pattern of the present invention can inhibit a prey recognition response in a predator. Specifically, a predator does not recognize the user of a coloration pattern and/or method of the present invention as potential prey. In on embodiment, the present invention also prevents an avoidance response, thereby minimizing the disturbance to the animal.

B. The Importance of Color/Visual Queues

Aquatic animals can make a determination as to whether another animal is poisonous or in some other way dangerous. Oftentimes potential prey provides visual cues to the predator that the potential prey should not be eaten or that the potential prey forms part of a cooperative relationship and therefore should not be eaten.

Further, as described above, coloration is also important to obfuscate the presence of an aquatic animals eyes and body shape. Specifically, the color of the animal's eyes can blend into the coloration and coloration pattern of the animal, thereby inhibiting a predator from recognizing the animal as potential prey.

C. The Exploitation of the Recognition Pathways and Color

The present invention exploits the above described pathways, adaptations and colors of the animal world and provides methods and compositions that can protect man from potential predators, enhance man's interaction with other animals, and in some embodiments simultaneously protect man from potential predators and enhance man's interaction with aquatic animals. Additionally, in some embodiments the present invention simultaneously inhibits the predator/prey recognition response in generally passive animals and predators, and can, in some embodiments, induce an avoidance response in the same animals when viewed from a different angle. Further, in some embodiments, the present invention provides methods and compositions that can be attractive to aquatic animals.

Following the teachings described herein, one can design 1) a coloration pattern for aquatic gear that inhibits a predator/prey recognition response, and/or 2) a coloration pattern that is attractive to aquatic animals. In one embodiment, a suitable coloration patter can simultaneously inhibit a predator/prey recognition response and also be attractive to one or more aquatic animals. Any of the herein described embodiments can find particular application with respect to underwater hunters, underwater photographers and scuba divers. For example, because typical underwater hunters have a limited amount of time under water (limited because of breath holding ability), it can advantageous to follow the teachings of the present invention to design coloration patterns for aquatic gear which are particularly attractive to certain generally passive animals, e.g., hogfish and the like.

It should be noted that "an avoidance response" is significantly different from inhibiting the predatory animal's ability to recognize the target animal as prey or from inhibiting a passive animal from recognizing another as a predator (referred to herein as inhibiting the predator/prey recognition response or inhibitory response). In an avoidance response, (typically elicited by large eye-like patterns) the predator recognizes the target animal as potential prey but does not attack because it's own safety is believed to be at risk. With an inhibitory response, the potential predator is substantially prevented from even recognizing the target animal as prey in the first place, and therefore the target animal is typically ignored altogether.

Accordingly, in some embodiments, the present invention can simultaneously inhibit generally passive animals from recognizing the wearer as a predator, as described above, and thereby enhancing the wearer's interaction with the generally passive animals, and can also inhibit the ability of a predator to recognize a diver or other person wearing a coloration pattern of the present invention, as prey, thereby protecting the wearer.

2. Aquatic Gear Adapted in Light of the Above Described Predator/Prey Recognition Pathways In one embodiment, the present invention exploits one or more of the predator/prey recognition pathways described above. The present invention can confuse predators and/or generally passive animals by reducing the animal's ability to determine the probable location of eyes of the wearer. Specifically, one embodiment of the present invention inhibits the predator/prey recognition response through the use of certain coloration patterns on equipment and clothing, including but not limited to the aquatic gear described herein.

Accordingly, in an embodiment of the present invention where the inhibition of a predator recognition response is desirable, suitable coloration patterns for the inhibition of a predator recognition response can be substantially similar to, but are not limited to, the coloration pattern of an adult or terminal phase animal selected from the following group of adult animals: pilotfish including *Naucrates ductor*, rudderfish including *Seriola zonata*, sharksuckers including *Echeneis naucrates*, sand divers such as *Synodus intermedius*, trumpetfish including *Aulostomus maculatus*, cornetfish including *Fistularia tabacaria*, cardinalfishes including *Apogon maculatus*, squirrelfish including *Plectrypops retrospinis*, hamletfish including *Hypoplectrus unicolor*, basslets including *Gramma melacara*, basslets including *Serranus tigrinus*, jacks including *Seriola dumerili*, runners such as *Elegatus bipinnulata*, grunts including *Haemulon plumieri*, porkfish including *Anisotremus virginicus*, drums including *Equetus lanceolatus*, butterflyfish including *Chaetodon capistratus*, spadefish including *chaetodipteris faber*, angelfish including *Holacanthus ciliaris*, damselfish including *pomacentrus planifrons*, gobies including *Gobiosoma oceanops*, hawkfish including *Amblycirrhitus pinos*, wrasses including *Hallichoeres maculipinna*, hogfish including *Lachnolaimus maximus*, parrotfish including *Scarus taeniopterus*, triggerfish including *Balistes vetula*, filefish including *Aluterus scriptus*, trunkfishes including *Lactophrys quadricornis*, burrfish, porcupinefish, lionfish, pufferfish and banded cleaner shrimp. Other suitable aquatic animals can be found following the teachings set forth herein and examining the animals described in webpage having the address: www.fishbase.org, the entire content of which is hereby incorporated by reference.

Juvenile and intermediate color patterns of any of the above described suitable animals may also be used as a basis for one or more coloration patterns for use in the present invention.

Preferably an overall coloration on a piece of aquatic gear can be at least about 5%, 10%, 20%, 30%, 40%, 50%, 60%, 70%, 80%, 90%, 95%–99%, or 100% the coloration an animal selected above. The percent identity of overall coloration can generally be determined by calculating the proportion of each color relative to the total visible surface area of the animal and comparing the result to the proportion of each color on a piece of aquatic gear of the present invention, either alone or in combination. For example, comparing an animal that is 50% black and 50% white, and a wetsuit that has a visible surface area that is 55% white and 45% black, such a wetsuit would be about 90% identical to the animal based on coloration.

Similarly, in some embodiments, the pattern of the color (or color scheme) is 5%, 10%, 20%, 30%, 40%, 50%, 60%, 70%, 80%, 90%, 95%–99%, or 100% identical to the color scheme of a suitable aquatic animal. The percent identity of a color scheme can be made similar to the determination of "% identity" as described above. However, another method of determining "% identity" with respect to color scheme involves noting the points of color contrast in a high resolution black and white image of an aquatic animal and overlaying an appropriately sized black and white image of the animal on a piece of aquatic gear. With such a method, the areas that closely overlap in contrast can be considered identical. By adding up the total number of areas of contrast on animal and the aquatic gear and the number of overlaps, the "% identity" of overall color scheme can be found.

In some embodiments, the color scheme and overall coloration combined (referred to herein as "coloration pattern") can be 5%, 10%, 20%, 30%, 40%, 50%, 60%, 70%, 80%, 90%, 95%–99%, or 100% identical to the color pattern of a suitable aquatic animal.

Figure 2:
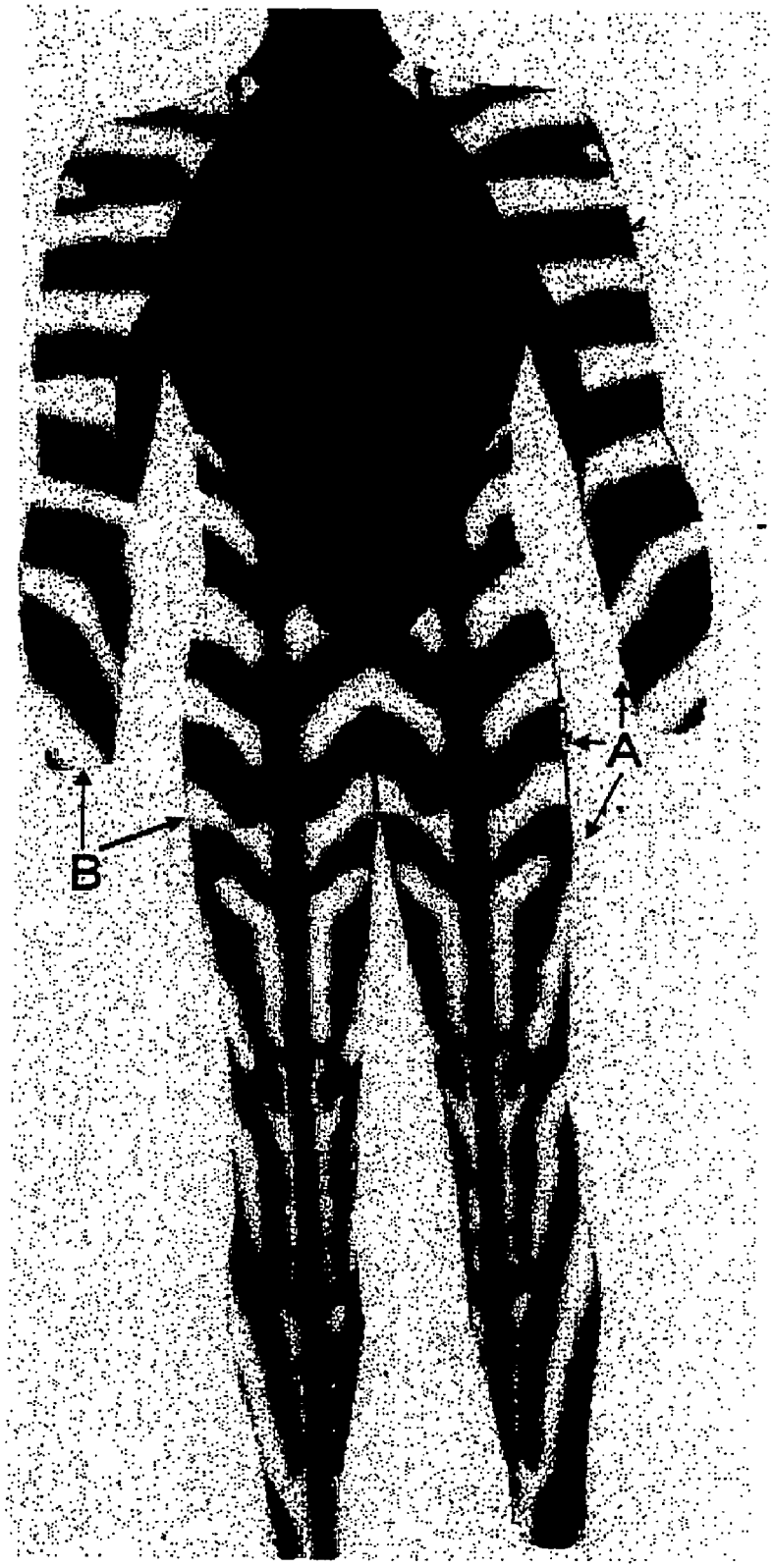
FIG. 2 shows a wetsuit having a coloration pattern of the present invention.

In the present invention, a suitable coloration pattern for the inhibition of a predator recognition response can be substantially similar to, but are not limited to, the coloration pattern as shown in FIG. 2, which shows a coloration pattern which is at least 50% identical to the coloration pattern of an adult lionfish, if the colors black and white or red and white are used for areas "A" and "B".

However, colors of areas "A" and "B" referenced in FIG. 2 can be any color. However, in certain preferred embodiments, the colors can be red, blue, black, yellow or green. In other embodiments areas "A" and "B" are different colors. In other preferred embodiments, the colors chosen are selected from colors that are complementary, namely colors that reflect light in regions of the visible spectrum where the other does not. For example, yellow and dark blue or black and white.

Accordingly, a coloration scheme on aquatic gear that is substantially the same as a coloration scheme exhibited by an animal set forth above, can be used with a different overall color than that exhibited by the animal. Therefore, coloration patterns which do not exist in nature can also be used and can be readily developed by a skilled artisan by following the teachings set forth herein.

In one embodiment, the present invention provides a method for a target animal (e.g., man) to passively interact or avoid a predatory animal by the use of color scheme and/or overall coloration including the steps of determining an overall coloration and/or color scheme having at least two distinct colors (thereby determining a "coloration pattern"), applying the determined coloration pattern to one or more selected items adjacent the target animal (man), and wherein the coloration pattern inhibits the predatory animal's ability to recognize the target animal as prey, thereby providing the benefit of passively protecting the wearer from aquatic predators (e.g., sharks). In another embodiment, the coloration pattern inhibits a generally passive animal's ability to recognize the target animal as a potential predator, providing the advantage that the user/wearer can more closely approach aquatic animals. In yet another embodiment, a coloration pattern is attractive to an aquatic animal (either by virtue of the coloration pattern, or by employing particular colors, as described below), thereby allowing the wearer to closely approach an aquatic animal and/or causing an aquatic animal to approach the wearer. Accordingly in one embodiment, an aquatic animal can closely approach a user of a coloration pattern of the present invention. In another embodiment, the user of a coloration pattern of the present invention can more closely approach the aquatic animal than without the use of a coloration pattern of the present invention.

In one embodiment, a coloration pattern of the present invention is applied to aquatic gear including but not limited to swimsuit/bathingsuits, wetsuit, dive skin, rashguard, buoyancy compensating device, fins, booties, mask, snorkel, weight belt, drysuit, semi-drysuit, flashlights, camera, dive-reel, buoyancy bags, and dive knife. Typically, the coloration pattern covers at least 5%, 10%, 20%, 30%, 40%, 50%, 60%, 70%, 80%, 90%, 95%–99%, or 100% of the surface area of each piece of aquatic gear.

Further, as noted above some of the above described embodiments can also be attractive to aquatic animals. In preferred embodiments, the coloration patterns are attractive to aquatic animals because the aquatic animal is confused into believing the wearer/user is part of a cooperative relationship with the aquatic animal. For example certain wrasses and cleaner shrimp exhibit distinct coloration patterns that can attractive to aquatic animals, for the reasons described below. These animals are involved in cooperative relationships with other aquatic animals, and although attractive to other aquatic animals, are typically unharmed by other aquatic animals which is advantageous to the wearer/user of the aquatic gear of the present invention. Further, other aquatic animals typically interact with wrasses and cleaner shrimp in a manner so as to be immobile while the wrasses and cleaner shrimp clean the aquatic animal. Such a reaction to a diver or underwater hunter or underwater photographer can also be very desirable.

3. Combinations of Coloration Patterns

In one embodiment, to provide additional protection advantages, the compositions and methods of the present invention can also optionally include a second coloration pattern, wherein the second coloration pattern is different from the first coloration pattern in at least one of the following ways: 1) overall coloration and 2) color scheme, and wherein the second coloration pattern can also inhibit a predator/prey recognition response or alternatively elicit an avoidance response. Typically a second coloration pattern can be used when the target animal is a human and the second coloration pattern is positioned adjacent the human. In a preferred embodiment, the second coloration pattern covers at least a portion of the aquatic gear. Additionally, in embodiments wherein the second coloration pattern is designed to elicit an avoidance response, it is preferable that the second coloration pattern covers a portion of the aquatic gear that faces the water surface (e.g., back, tank, tank strap, bottom of fins, or other surface facing portions of aquatic gear). More specifically, the second coloration pattern preferably covers at least a portion of the diver that would be viewable from the surface if a diver's chest was facing the bottom of a body of water.

However, it should be noted that in certain embodiments, the positioning of coloration patterns of the present invention can change depending on the particular needs of the wearer. For example, a wearer of coloration patterns of the present invention may want to have a pattern which induces an avoidance response on the front of the wearer, and coloration pattern which can inhibit a predator/prey recognition response on the back of the wearer.

Accordingly, in some embodiments of the present invention, wherein at least a second coloration pattern is positioned on aquatic gear which can elicit an avoidance response, animals positioned below and in front of the human perceive a first coloration pattern which inhibits a predator/prey recognition response and animals positioned above and behind the human perceive a coloration pattern that can elicit an avoidance response. Thus, in such embodiments the prey recognition response can be inhibited in animals in front of the human and the human can have enhanced interaction with those animals. Further, in such embodiments, an avoidance response can be elicted from animals which approach the human from above and behind, thus enhancing the safety of the human.

In some embodiments, at least a portion of a second coloration pattern can generally resemble an "eye-like" pattern (an "eye-like" pattern can typically be a circular, spotty or blotchy pattern). In some embodiments the color change from one color to another can be abrupt.

It should be noted that coloration patterns which can elicit an avoidance response in predators can also elicit an avoidance response in passive animals. Accordingly, it is preferable, although not required, to carefully place coloration patterns which induce/elicit avoidance responses from predators and generally passive animals out of the line of sight of the generally passive animals of interest to the wearer (e.g., on the tank and/or bottom of fins in diving applications).

4. Ultraviolet Coloration

Because fish live at depth, the amount of light and type of light available for vision is different than that available to land animals. As shown in FIG. 1, the percentage loss of light per meter as a function of wavelength can vary greatly, with low wavelength light and UV having the least loss per meter in clear tropical waters. It has been shown that man is likely blind to many critical aspects of the coloration of fish at depth and aquatic animals perception of their environment, as detailed in G. S. Losey et al., "The UV visual world of fishes: a review" Journal of Fish Biology, 54, 921–943 (1999), the entire content of which is hereby incorporated by reference. More specifically, the human visual system is different to that of many, if not most, aquatic animals and therefore man cannot fully interpret the colors of aquatic animals with the naked eye, as described in "Communication and camouflage with the same 'bright' colours in reef fishes" by N. Justin Marshall, Phil. Trans. R. Soc. Lond. B 355, 1243–1248 (2000), the entire content of which is hereby incorporated by reference.

Accordingly, in some embodiments, the present invention uses the UV spectrum to construct color schemes, overall coloration and coloration patterns to cover aquatic gear such that the gear a) is passively attractive, and/or b) is actively attractive and/or c) has enhanced camouflage.

4a. Passively Attractive Coloration

Figure 3:
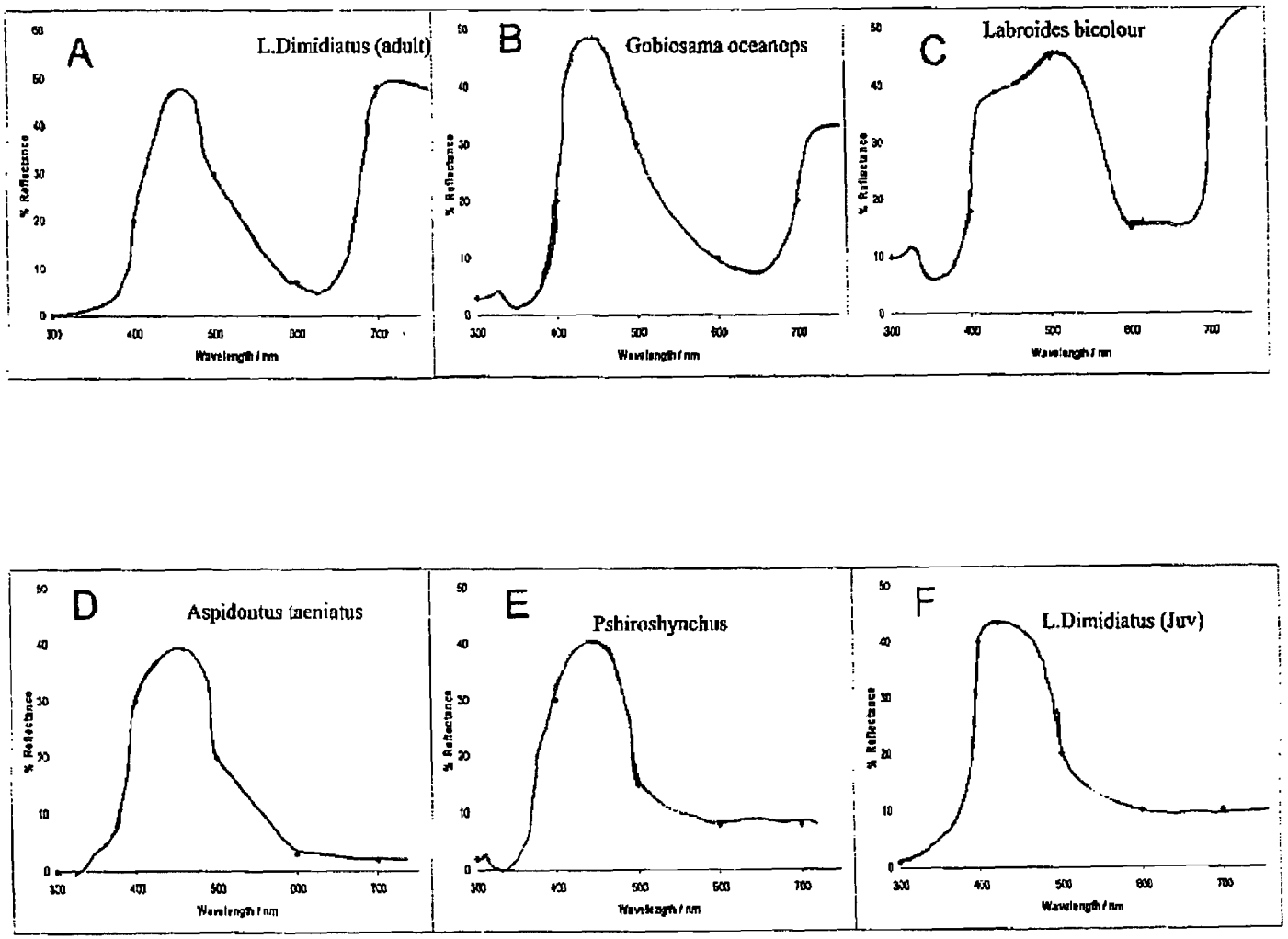
FIG. 3 shows color components of certain fish viewed in the UV spectrum.

Certain aquatic animals exhibit striking coloration when viewed in the UV spectrum. As shown in FIG. 3, the coloration of certain fish (e.g., cleaner fish A, B, and C) have multiple color components when viewed in the UV spectrum, and these components are indistinguishable to man yet apparently visible to many aquatic animals. Accordingly, in one embodiment the present invention applies such colors to aquatic gear. In one embodiment, the present invention employs at least one color that reflects in the about 400 to about 500 nm range. In another embodiment, the present invention employs a color that has a peak reflectance at about 425 nm. In another embodiment, the present invention employs colors that reflect UV light at a longer wavelength, typically greater than about 650 nm, more preferably greater than about 700 nm. In yet another embodiment, the present invention employs at least one color that reflects in the about 400 to about 500 nm range and a second color that reflects UV light at a longer wavelength, typically greater than about 650 nm, more preferably greater than about 700 nm.

By "about" is meant + or −10% of the referenced number.

In one example, a wetsuit can be developed which is attractive to colorful reef fish and which can cause the reef fish to slow or stop aquatic animal movement, which can be useful to underwater photographers because the aquatic animals confuse the coloration on the aquatic gear with cleaner fish and the aquatic animals can present themselves to be cleaned.

4b. Actively Attractive

In another embodiment, the UV reflective colorations can be used to generate a coloration pattern that is actively attractive to aquatic animals. Essentially, the coloration pattern acts a lure. In one embodiment, the coloration pattern includes colors in the UV spectrum, which is imperceptible to man. Following the experimental procedures set forth below, coloration patterns that use UV reflectance to actively attract aquatic animals can be developed.

Figure 4:
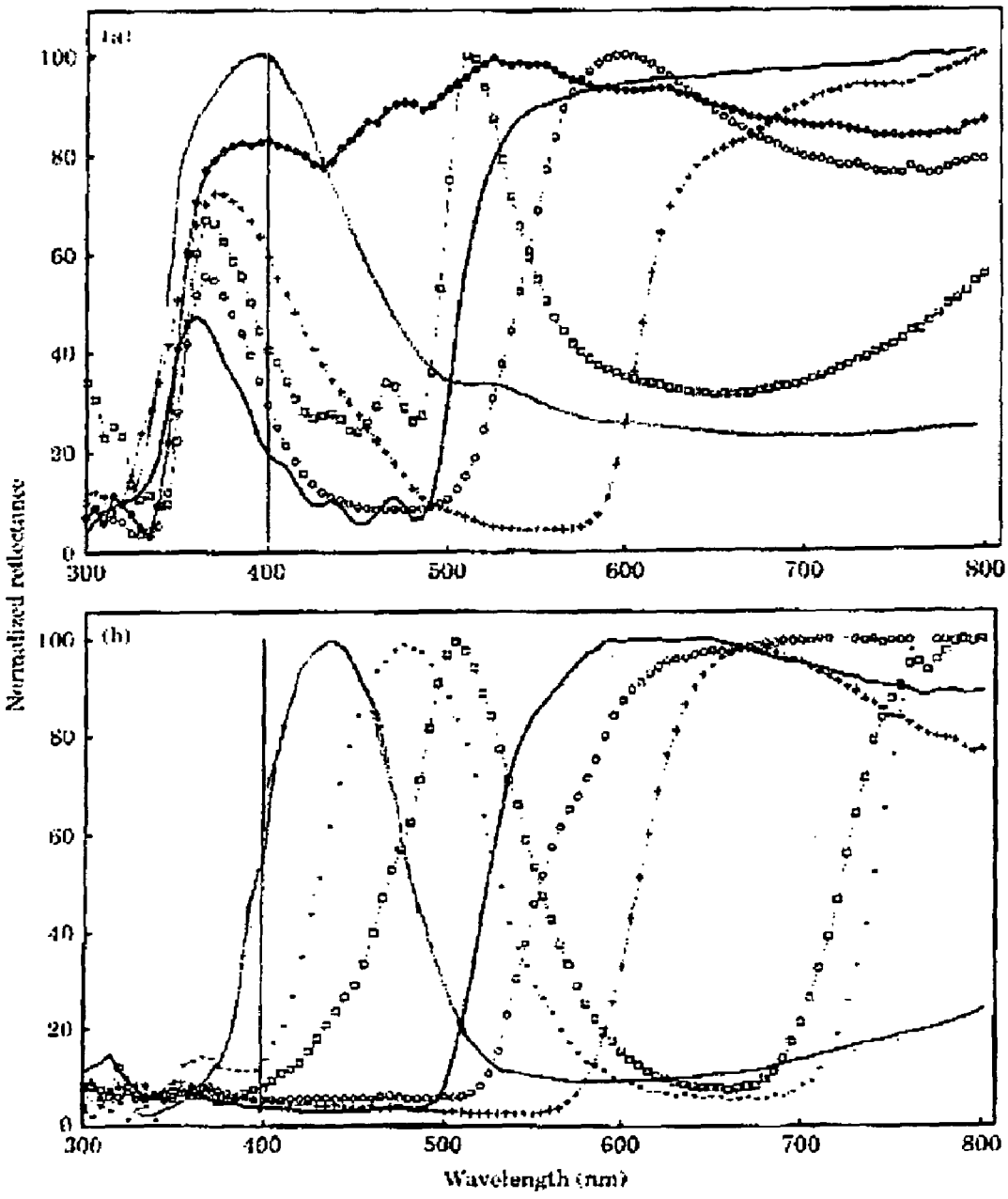
FIG. 4 shows color components of certain fish viewed in the UV spectrum.

As mentioned above, examples of spectra (e.g.. the spectra set forth in FIG. 3) for use in the present invention can be obtained from fish colors. FIG. 4 presents a comparison of wavelength colors that include colors having a UV component (a) and colors without a UV component (b). The human visual system is sensitive to wavelengths to the right of the vertical bar at 400 nm, depicted in FIG. 4. To the left of this bar the UV wavelengths between 300 and 400 nm are visible to fish and therefore are examples of colon for use in certain embodiments of the present invention.

4c. Enhanced Camouflage

Because many aquatic animals have vision that involves the UV spectrum, most, if not all land based camouflage techniques can be subject to failure in an aquatic environment. Although a camouflaged diver may be less visible to another human at depth, unless the camouflage takes into consideration the UV spectrum, it is likely that the diver will be openly visible to aquatic animals that have UV receptors.

Accordingly, following the experimental procedures set forth hereinbelow, enhanced camouflage, which involves the UV component colors can be readily developed to more effectively hide the presence of the wearer from aquatic animals with UV visual acuity or with visual acuity that is particular to their environment using the information set forth in FIG. 1 (e.g., aquatic animals in conditions as in line 9 of FIG. 1 may rely heavily on light in the 550 to 600 nm range) using the teachings set forth herein.

5. Kits and Compositions

Another aspect of the present invention involves kits and compositions which can be useful for the modification of aquatic gear, including but not limited to aquatic gear having a previously applied or generated coloration pattern.

Material having a coloration pattern according to the present invention can be removably or permanently affixed to existing gear via a fastening composition. Preferably, the material can be removably affixed or attached to existing gear for the reasons set forth below.

The coloration pattern can be permanently affixed using appropriate dyes and/or screenprinting techniques, polymers, shrinkwrap, or sublimation. The coloration pattern can be removably affixed to the gear using fastening components which include, but are not limited to one or more of snaps, straps, ties, pocket inserts, zippers, laces, buttons, and Velcro® brand fasteners, or by the compression action of the gear itself (e.g. wearing a shirt of the present invention over a wetsuit removably affixes the pattern to the wetsuit). Additionally, with certain types of fastening components, it may be necessary to permanently affix a first portion of the fastening component. For example, if Velcro® brand fasteners are to be used (which involves two portions, a hook portion and a loop portion), a first portion can be permanently affixed to the gear, so that the second portion can be removably affixed to the gear thereafter. For example, the embodiment depicted in FIG. 2 can be a neoprene wetsuit, a skin or a piece of aquatic gear which can then be removably (or permanently) affixed to a wetsuit, drysuit, or skin by a zipper in the back (not shown) or other fastening device. Alternatively, the embodiment can be worn directly over another piece of aquatic gear.

A material that is permanently affixed to the gear can also be permanently affixed using an appropriate glue, preferably a waterproof glue. Alternatively, in some embodiments, the aquatic gear can be adapted during manufacture so that coloration patterns of the present invention can be removably affixed thereto, thereby eliminating the need for additional fastening components. For example, a loop portion of Velcro® can be integrated into the manufacture of dive gear, thereby facilitating the attachment of the hook portion of Velcro®, which can have a coloration pattern of the present invention attached thereto.

By adapting aquatic gear to have a removably affixed coloration pattern, the coloration pattern can be altered to meet the particular needs of the wearer. For example, an appropriate coloration pattern which can be effective at inhibiting a predator/prey recognition response and/or induce an avoidance response, can vary from Pacific waters, Atlantic waters, planned depths and other environmental factors. The coloration pattern can also be altered based on the type of animals known to be in the area. By enabling a coloration pattern to be removably affixed to aquatic gear, the coloration pattern on the aquatic gear can be optimized and/or customized depending upon the needs of the user.

In another embodiment, the affixed material further includes pockets, and preferably pockets having closures. Such closures can include, but are not limited to Velcro® brand closures, snaps, laces, ties and zippers.

In another embodiment, the removably or permanently affixed material includes one or more of a "glow in the dark" substance including, but not limited to photoluminescent substances or aquatic gear construction materials, including photoluminescent threads, plastics, other polymers such as neoprene, or paints. Photoluminescent materials are readily available from www.glo-net.com. Such photoluminescent substances can be obtained in a variety of colors, and they are therefore suitable for integration into the coloration patterns of the present invention. Such substances can be particularly useful for night dives or dives where visibility is poor, thereby enhancing the visibility of the wearer and improving safety. Such substances also enhance the visibility of the coloration pattern of the present invention to generally passive animals and potential predators in reduced light conditions, thereby further enhancing the safety and efficacy of one or more coloration patterns of the present invention.

In some embodiments, the wavelength of light emitted from the photoluminescent material is a color visible to man. In other embodiments, the photoluminescent material can emit a color that is not visible to man, but can be visible to certain species of aquatic animals (e.g., UV spectrum), as described above.

Accordingly, one embodiment of the invention provides a first coloration pattern during normal light conditions, and provides an illuminated coloration pattern that can be viewed during reduced light conditions. Such photoluminescent coloration patterns can be visible by man and/or generally passive animals and/or predators (due to differences in visual acuity). The illuminated coloration pattern can be the same as or different from the coloration pattern visible during normal light conditions, however such photoluminescent coloration patterns can also induce an avoidance response and/or inhibit a predator/prey recognition response or be attractive to aquatic animals, independent from the coloration pattern viewable during normal light conditions.

In another embodiment, the aquatic gear can be designed such that during normal light conditions, the photoluminescent material can blend into a coloration pattern of the present invention. However, in reduced light conditions, the photoluminescent material can present the same or a different pattern than that presented during normal light conditions, depending upon the placement and amount of the photoluminescent material used.

Further, light reflective materials (typically white in coloration, but can include multiple coloration, e.g., red, blue and/or green) can also be used in certain embodiments of the present invention to form color schemes and coloration patterns.

Suitable materials for the attachment of the coloration patterns of the present invention to aquatic gear include, but are not limited to Lycra®, neoprene and plastic.

In some embodiments at least 5%, 10%, 20%, 30%, 40%, 50%, 60%, 70%, 80%, 90%, 95%–99%, or 100% of the surface area of the aquatic gear should be covered in an appropriate coloration pattern that can be removably or permanently affixed to the aquatic gear.

6. Particular Aquatic Gear

Aquatic gear can be any material, but typically includes neoprene and/or other synthetic or natural fabrics including vinyl, lycra and/or cotton. In on embodiment, the aquatic gear can include the material described in U.S. Patent Application Publication Nos. 20040131838 and 20030010486, both to Serra et al., the entire contents of which are herby incorporated by reference.

a. Wetsuit

The present invention ignores the traditional color scheme of wetsuits and provides wetsuits that have a coloration pattern which can inhibit the predator/prey recognition response of aquatic animals and optionally induce an avoidance response and optionally be attractive to an aquatic animal.

At least 5%, 10%, 20%, 30%, 40%, 50%, 60%, 70%, 80%, 90%, 95%–99%, or 100% of the surface area of the wetsuit should be covered in at least one coloration pattern of the present invention.

Although the coloration pattern is described generally above, in some embodiments the coloration pattern on the front (the portion viewable from below when a diver is on the surface of the water) is lighter relative to the back (the portion viewable from above when the diver is on the bottom). The frontal colors can include, but are not limited to, colors such as white, blue, green, red, yellow, silver, light blue, dark blue, or light gray. The back colors include, but are not limited to darker colors such as dark gray, blue and black. The exact color choice and position of the coloration pattern on the aquatic gear will vary depending upon the particular needs of the wearer, (for example, if an avoidance response is required, then the back can contain brighter colors than the front).

b. Buoyancy Compensating Device

Although the buoyancy compensating device can be used without a wetsuit underneath, it is preferable that a buoyancy compensating device of the present invention be used with a wetsuit and have a similar coloration pattern thereon as the wetsuit. Specifically, the pattern of the buoyancy compensating device should closely match the pattern of the wetsuit, to maximize the effectiveness of the method and compositions.

However, it should be noted that the patterns between the buoyancy compensating device (and other pieces of aquatic gear, such as those described herein) and wetsuit do not have to precisely match, and in some cases, it may be found to be advantageous to have different coloration patterns on the buoyancy compensating device and wetsuit and other aquatic gear.

Additionally, the back portion of the buoyancy compensating device as well as the tank strap may also include alternative colors to induce an avoidance response in animals which can viewed from above and behind, as described above.

c. Gear Generally

It is believed that any aquatic gear, including mask, fins, tank, and wetsuit, can be adapted by one of skill in the art given the teachings set forth herein.

The different colors of a coloration pattern of the present invention can be present in any suitable color scheme, as described above, and can be present in slash, swirl, regular or irregular patterns. Preferably, the color change from one color to another can be gradual, however in some embodiments the color change can be abrupt.

Additionally, in some embodiments, all of the aquatic gear used by a particular person has the same coloration pattern. More specifically, as a whole, the gear can have the same coloration pattern and the coloration pattern of one piece of gear can therefore naturally flow into another. It is believed that by using the same coloration pattern on all of the aquatic gear, the inhibition of a predator/prey recognition response can be synergistically enhanced due to an overall reduction of abrupt color changes from pieces of aquatic gear to other pieces of aquatic gear.

7. Methodology for Determining Appropriate Coloration Patterns

The coloration pattern of some embodiments may be more effective at inducing an avoidance response than other embodiments. Similarly, the coloration pattern of some embodiments may be more effective at inhibiting a predator/prey recognition response. Further, some embodiments of the present invention can be more effective at simultaneously inducing an avoidance response in predators, while also inhibiting a predator recognition response in generally passive animals. And other embodiments can be more attractive to aquatic animals than others.

Therefore, in order to adapt the present invention to the particular needs of the user, certain embodiments can be tested for the ability to induce one or more of 1) an avoidance response and/or 2) inhibit the predator/prey recognition response. In particular, a coloration pattern can be applied to a particular piece of aquatic gear, including, but not limited to the gear set forth above, and tested by optionally exposing the equipment to one or more of: 1) aquatic predators, and 2) generally passive aquatic animals and observing the response of each, if any.

In embodiments wherein it is particularly desirable to develop a coloration pattern that significantly inhibits a predator/prey recognition response, or to develop a coloration pattern that can be considered "attractive" to certain animals (the distance between the aquatic animal and man is minimized), certain steps can be followed. First, repetition of exposure of one or more aquatic animals to a coloration pattern and second, gradually changing the percent identity of the coloration pattern to a reference animal and/or changing the coloration pattern generally. These steps can be readily performed to thereby arrive at an optimal attractive coloration pattern for one or more particular aquatic animals. Such aquatic gear developed using the above described techniques can find particular utility for underwater hunting, as detailed above, and in particular to determine a coloration pattern that is attractive to a particular species of aquatic animal.

The order the steps in the method described above can be altered. Preferably at least one step is performed for each tested coloration pattern, preferably both steps are performed, thereby obtaining a coloration pattern which maximizes the inhibition of the predator/prey recognition response. Although a mannequin wearing a wetsuit according to the present invention is described below, it is believed that one of skill in the art can apply the methodology described above to other pieces of aquatic gear to determine appropriate desirable coloration patterns.

Following the description set forth herein, it is believed that other aquatic gear, e.g., hoods, regulators and fins, could also be modified to yield the benefits of the present invention. Additionally, following the disclosure set forth herein, coloration patterns which are developed without guidance from the natural coloration pattern of aquatic animals can also be developed. Although preferred embodiments of the present invention include, but are not limited to, coloration patterns which mimic generally passive animals, through trial and error following the method set forth above, it may be possible to derive a hypothetical coloration pattern which will more strongly inhibit the predator/prey recognition response than a coloration pattern found in nature. In other embodiments, the present invention provides coloration patterns which are attractive to one or more particular aquatic animal species, and can, in some instance, effectively make the wearer into a lure.

While the majority of the description herein focuses on the behaviors of aquatic life, and in particular marine animals, the methods described herein can also be applied to land based use with minimal experimentation using the techniques described herein.

Definitions

As used herein, the term "about" means plus or minus 10% of the value referenced, inclusive of the value referenced.

As used herein, the term "substantially similar to" means "approximately the same as." With respect to certain coloration patterns of the present invention, "substantially similar" to a coloration pattern of an animal means that one of skill in the art can determine the animal upon which a particular coloration pattern is based upon visual inspection, if the coloration pattern is based on an animal.

EXAMPLE 1

A wetsuit having a coloration pattern that is about 80% identical to a juvenile form of the parrotfish *Scarus taeniopterus* (and having the appropriate UV reflectance) can be applied to a human mannequin. The mannequin can then be immersed in water in a location known to contain a high concentration of aquatic predators (tiger sharks, bull sharks, great white sharks, etc.). Preferably, the gear can be immersed with an underwater camera to observe the reaction of the aquatic predators to the presence of the mannequin and the effect of the coloration pattern of the wetsuit. Additionally, a "control" piece of gear, (i.e. a mannequin wearing a black wetsuit) can also be present for comparative purposes. Preferably, the mannequin can be slowly trolled behind a boat either below or on the surface of the water.

During the trolling of the mannequin, the underwater cameras can observe aquatic predators behavior toward the mannequin by monitoring variables which can include, but are not limited to, the number of successful and unsuccessful attacks, pursuit time, and position on the body of any successful attacks. Accordingly, coloration patterns which minimize the number of successful attacks, and/or maximize the number of unsuccessful attacks and/or increase pursuit time and/or increase the likelihood that any successful attack will be directed to a portion of the mannequin body that would result in non-fatal injury if a human was wearing the wetsuit, are to be considered desirable.

EXAMPLE 2

The mannequin wearing a wetsuit selected as described in Example 1 can be positioned in water as described above, and using underwater cameras, the reaction of generally passive aquatic animals can be observed by monitoring variables which can include but are not limited to approach distance and aggressive/territorial behavior. Accordingly, coloration patterns which 1) minimize approach distance (and thereby show a minimizing of any avoidance response induced by the coloration pattern or provide indicia of "attractiveness" of the coloration pattern) and 2) minimize aggressive/territorial behavior, are considered desirable.

EXAMPLE 3

A database of coloration, pattern, animal type and animal type reaction (aggressive, territorial, etc.) toward the coloration pattern can be developed. Such a database can be useful for the customization of coloration patterns to meet the particular needs of wearers of coloration patterns of the present invention. For example, a particular pattern can be developed and stored in the database that has particular application to underwater hunters, such as a pattern which is attractive to hogfish and/or other game fish.

In some embodiments, a coloration pattern of the present invention can also be applied to boats, surfboards, windsurfing boards and the like.

The embodiments described herein can be used alone or in combination with other embodiments, as appropriate using the disclosure of this invention. All patents and publications are also hereby incorporated by reference.

What is claimed is:

1. A method for a target animal to passively interact with a predatory animal by the use of patterns and coloration comprising the steps of:

determining a coloration pattern having at least two colors;

applying the determined coloration pattern to one or more selected items adjacent the target animal;

wherein the coloration pattern inhibits the predatory animal's ability to recognize the target animal as prey;

wherein a first color is in the visible spectrum and is between 400 and 500 nm in wavelength; and wherein a second color is greater than 700 nm in wavelength.

2. The method of claim 1 wherein said target animal is a man.

3. The method of claim 1 wherein said step of applying includes applying said coloration pattern to at least one of a wet suit, bathing suit, buoyancy compensating device, fins, and diving tanks.

4. The method of claims 1, wherein said coloration pattern further includes at least two separate and contrasting colors and wherein a change in said pattern from one color to another is abrupt.

5. The method of claim 1, further comprising a second coloration pattern, wherein the second coloration pattern is different from the first coloration pattern in at least one of the following ways: color and pattern; and wherein the second coloration pattern elicits an avoidance response in a predatory animal.

6. The method of claim 5, wherein the target animal is a human and the second coloration pattern is positioned on the back of the human.

7. The method of claim 5, wherein the target animal is a human diver having a pair of fins.

8. The method of claim 5, wherein the second coloration pattern is positioned on at least a portion of the fins.

9. The method of claim 5, wherein the second coloration pattern generally resembles an eye-like pattern.

10. A method for attracting a target animal by the use of coloration comprising the steps of:

applying a material to an item wherein the item is to be placed in an aquatic environment such that the material lures aquatic animals to the item;

wherein the material provides a color having at least first and second components;

wherein the first component is a color in the visible spectrum and has at least one peak wavelength between 400 and 500 nm; and wherein the second component is a color in the ultraviolet spectrum and has at least one peak wavelength between 300 and 400 nm.

11. The method of claim 10, wherein the material is applied to the item by the use of a polymer.

12. The method of claim 10, wherein the second component provides the color in the ultraviolet spectrum by photoluminescence.

13. The method of claim 10, wherein the second component provides the color in the ultraviolet spectrum by reflection and has a peak normalized reflection of greater than 20%.

* * * * *